US009572462B2

(12) United States Patent
Rozek

(10) Patent No.: US 9,572,462 B2
(45) Date of Patent: Feb. 21, 2017

(54) NAPKIN DISPENSER

(75) Inventor: Roy J. Rozek, Neenah, WI (US)

(73) Assignee: GEORGIA-PACIFIC CONSUMER PRODUCTS LP, Atlanta, GA (US)

( * ) Notice: Subject to any disclaimer, the term of this patent is extended or adjusted under 35 U.S.C. 154(b) by 128 days.

(21) Appl. No.: 13/403,418

(22) Filed: Feb. 23, 2012

(65) Prior Publication Data

US 2013/0221019 A1 Aug. 29, 2013

(51) Int. Cl.
*A47K 10/42* (2006.01)

(52) U.S. Cl.
CPC ..... *A47K 10/427* (2013.01)

(58) Field of Classification Search
USPC ..... 221/33, 36, 38, 41, 45, 56, 59, 61, 63, 221/303
See application file for complete search history.

(56) References Cited

U.S. PATENT DOCUMENTS 1,151,064 A * 8/1915 Swift ..... 221/63
1,158,550 A * 11/1915 Parsons ..... 206/494
1,605,231 A * 11/1926 Hoberg ..... 221/53
1,632,446 A * 6/1927 Krueger ..... 221/53
1,914,666 A * 6/1933 Hope et al. ..... 221/53
2,027,671 A * 1/1936 Broeren ..... 221/59
2,085,480 A * 6/1937 Shaffer ..... 221/54
2,143,614 A * 1/1939 Winter et al. ..... 221/53
2,253,742 A * 8/1941 West et al. ..... 221/52
3,836,045 A * 9/1974 Duhy et al. ..... 221/63
4,058,235 A * 11/1977 Cassia ..... 221/48
4,453,649 A * 6/1984 Origuchi ..... 221/26
4,678,099 A * 7/1987 Matsui ..... 221/48
4,679,703 A 7/1987 De Luca
4,694,973 A 9/1987 Rose et al.
4,768,679 A * 9/1988 Matsui ..... 221/48
4,838,454 A * 6/1989 Salzmann et al. ..... 221/57
4,877,154 A * 10/1989 Matsui ..... 221/48
5,219,092 A 6/1993 Morand
6,003,723 A * 12/1999 Morand ..... 221/44
6,286,713 B1 * 9/2001 Chan et al. ..... 221/49
6,378,726 B1 * 4/2002 Chan et al. ..... 221/51
6,419,113 B1 * 7/2002 Tramontina ..... 221/45
6,422,416 B1 * 7/2002 Tramontina ..... 221/45
6,508,382 B2 * 1/2003 Niada ..... 221/45
6,575,329 B2 * 6/2003 Clark ..... 221/45
D493,312 S 7/2004 Collins et al.
6,899,251 B2 * 5/2005 Christensen et al. ..... 221/53
6,981,610 B2 * 1/2006 Smiley et al. ..... 221/33
(Continued)

OTHER PUBLICATIONS

International Search Report and Written Opinion of the International Searching Authority for PCT/US2013/027069 mailed Jun. 4, 2013.

(Continued)

*Primary Examiner* — Gene Crawford
*Assistant Examiner* — Kelvin L Randall, Jr.

(57) ABSTRACT

A cover for a napkin dispenser includes an elongated dispensing aperture having a major and a minor axis. The cover also includes a pair of support members disposed on an inner surface of the cover on opposing sides of the elongated dispensing aperture. Each of the support members includes a central portion and the height of at least a portion of the central portion relative to the inner surface generally increases as a distance between the elongated dispensing aperture and the central portion increases.

26 Claims, 7 Drawing Sheets

(56) References Cited

U.S. PATENT DOCUMENTS

| | | | | |
|---|---|---|---|---|
| 6,988,635 | B2 * | 1/2006 | Hochtritt et al. | 221/44 |
| 7,124,911 | B2 | 10/2006 | Tramontina et al. | |
| 7,648,045 | B2 * | 1/2010 | Christensen et al. | 221/53 |
| 7,938,294 | B2 * | 5/2011 | Cittadino et al. | 221/62 |
| 2003/0019880 | A1 * | 1/2003 | Timmers et al. | 221/47 |
| 2003/0221986 | A1 | 12/2003 | Reinke et al. | |
| 2004/0099681 | A1 * | 5/2004 | Julius | 221/63 |
| 2004/0155051 | A1 * | 8/2004 | Magid | 221/59 |
| 2004/0206769 | A1 | 10/2004 | Sanders et al. | |
| 2005/0199643 | A1 * | 9/2005 | Smiley et al. | 221/63 |
| 2006/0273102 | A1 * | 12/2006 | Wieser et al. | 221/59 |
| 2007/0235467 | A1 * | 10/2007 | Heitmann | 221/38 |
| 2009/0212063 | A1 | 8/2009 | Cohen et al. | |
| 2009/0277920 | A1 * | 11/2009 | Cittadino et al. | 221/1 |
| 2012/0160864 | A1 * | 6/2012 | Shoaf et al. | 221/45 |

OTHER PUBLICATIONS

International Search Report for PCT/US2013/027069 date of mailing Jun. 4, 2013.

* cited by examiner

NAPKIN DISPENSER

BACKGROUND

The present invention generally relates to the field of dispensing systems and devices, and more specifically, to devices for dispensing napkins.

Napkin dispensers are well known in the art and are often provided at food service locations. Typical napkin dispensers include a stack of folded napkins supported on a pressure plate that is adapted to slide within the body of the dispenser and accommodate the varying thickness of the stack of folded napkins. A cover is mounted on one end of the dispenser body and has an opening through which the napkins are dispensed. The pressure plate and stack of napkins are urged toward the undersurface of the cover by a biasing mechanism that can include one or more springs, gravity or another suitable force.

Currently available paper napkin dispensers often experience difficulty in reliably feeding the napkins through the dispensing opening without damaging the napkin by way of tearing the napkin or jamming of the dispenser. Other issues with currently available napkin dispensers include permitting the removal of large quantities, or clumps, of napkins at one time. This typically leads to excess napkins being removed and wasted by users. In addition, when clumps of napkins are taken at one time, dispensers quickly run out and must be refilled inconveniencing both customers and operators of quick service food locations.

Accordingly, it is desirable to provide a napkin dispenser that reliably permits the removal of napkins one at a time with out damaging the napkin.

SUMMARY

According to one embodiment of the present disclosure, a cover for a napkin dispenser includes an elongated dispensing aperture having a major and a minor axis. The cover also includes a pair of support members disposed on an inner surface of the cover on opposing sides of the elongated dispensing aperture. Each of the support members includes a central portion and the height of at least a portion of the central portion relative to the inner surface generally increases as a distance between the elongated dispensing aperture and the central portion increases.

According to another embodiment of the present disclosure, a napkin dispenser including a napkin stack includes an enclosure, a pressure carriage disposed inside the enclosure and in communication with the napkin stack and a dispensing cover removably affixed to the enclosure. The dispensing cover includes an elongated dispensing aperture and a pair of support members disposed on an inner surface of the dispensing cover on opposing sides of the elongated dispensing aperture, each of the support members is operable for opposing a force exerted by the napkin stack. The height of at least a portion of each of the support members relative to the inner surface generally increases as a distance between the elongated dispensing aperture and the support members increases. The pressure carriage exerts the force on the napkin stack urging it towards the dispensing cover.

According to yet another embodiment of the present disclosure, a napkin dispenser includes an enclosure, a pressure carriage slidably disposed inside the enclosure and a dispensing cover removably affixed to the enclosure. The dispensing cover includes an elongated dispensing aperture and a pair of support members disposed on an inner surface of the dispensing cover on opposing sides of the elongated dispensing aperture, wherein a height of at least a portion of each of the support members relative to the inner surface generally increases as a distance between the elongated dispensing aperture and the support members increases.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
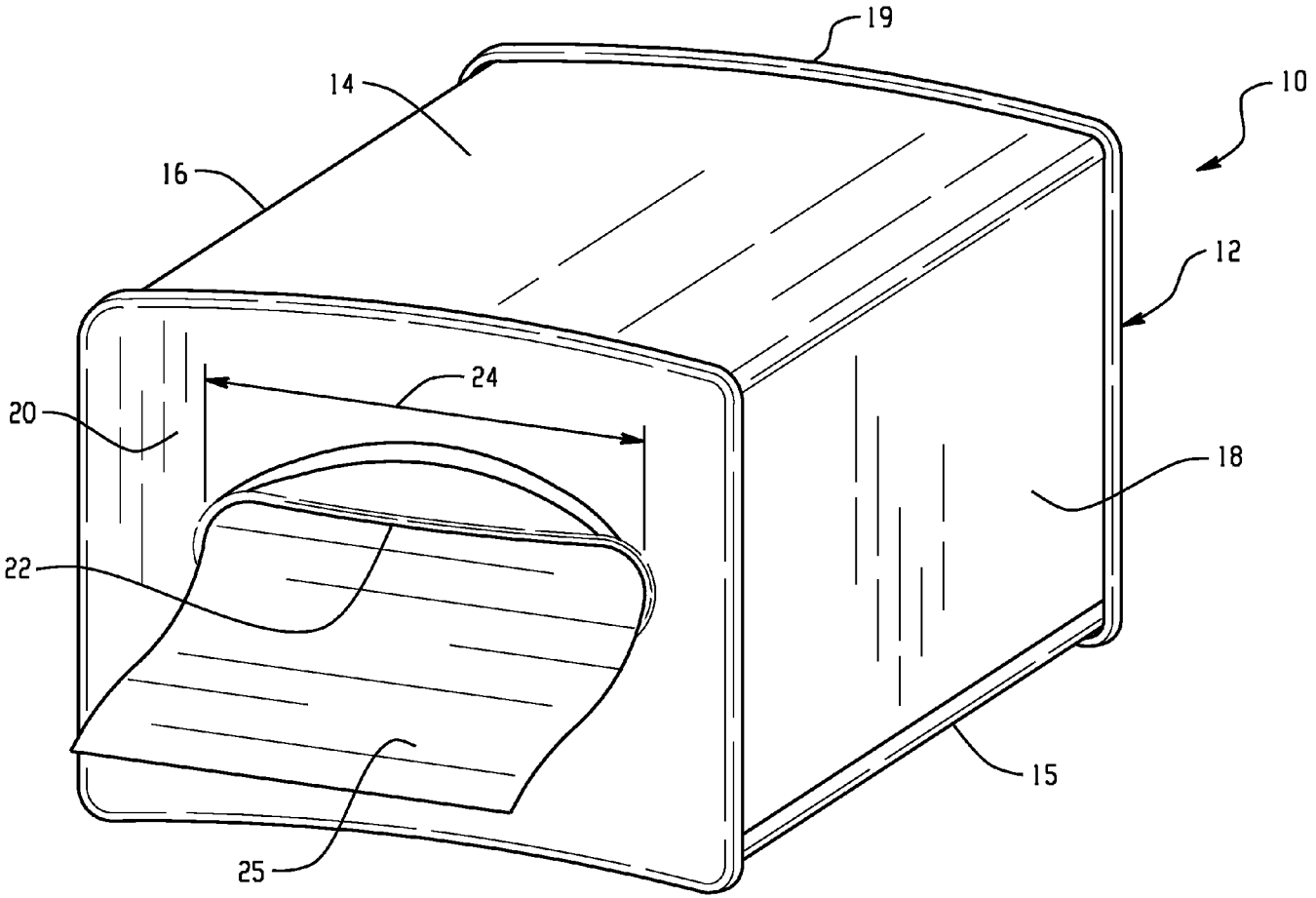
FIG. 1 is a perspective view showing a napkin dispenser constructed in accordance with an exemplary embodiment.
Figure 2:
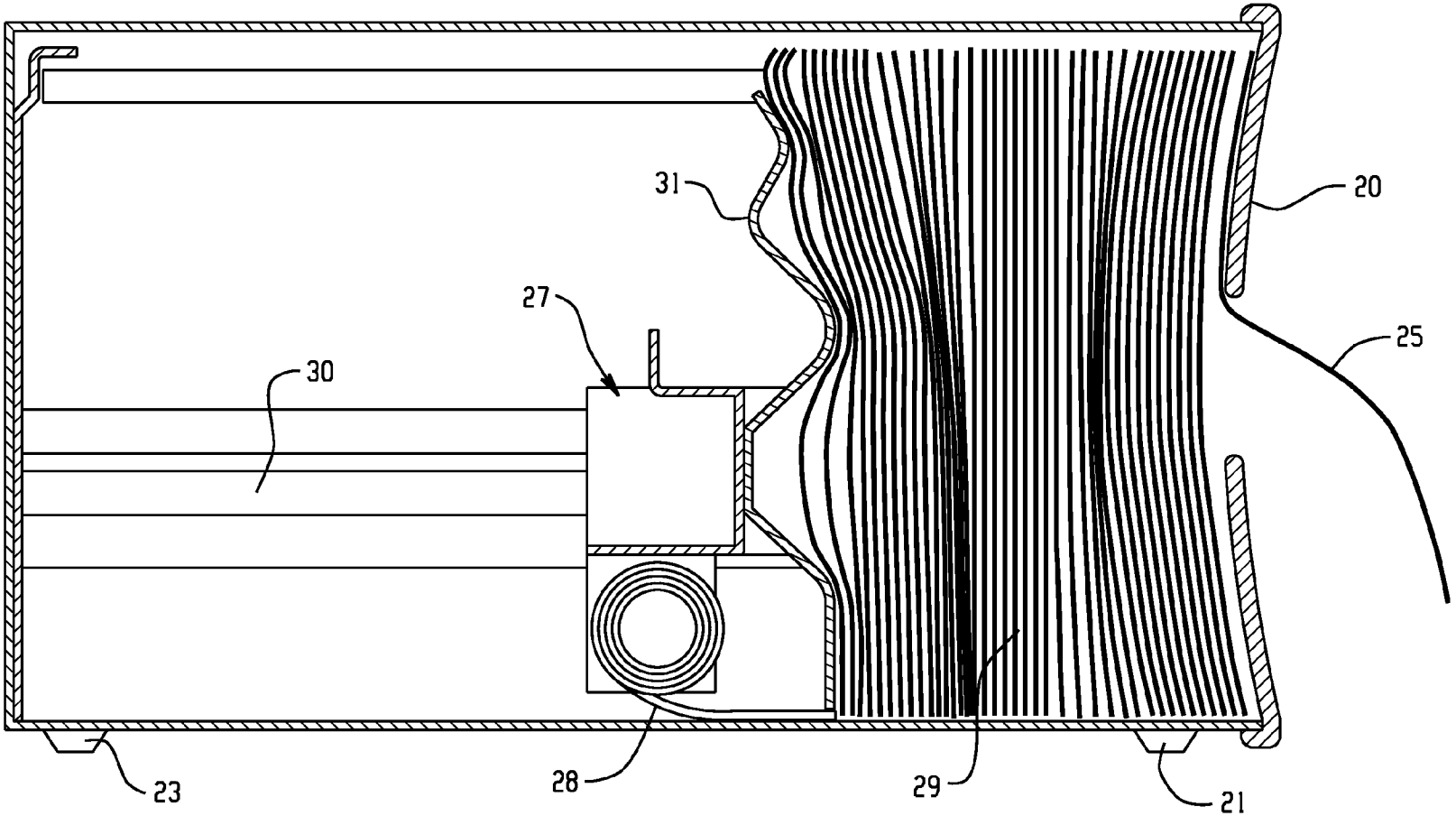
FIG. 2 is a cross sectional side view of the napkin dispenser of FIG. 1 with a stack of napkins loaded therein.

The invention is described in detail below with reference to the figures for purposes of illustration only. Modification to various embodiments illustrated within the spirit and scope of the present invention, will be readily apparent to one of skill in the art.

FIGS. 1-5 illustrate a napkin dispenser 10 that generally includes an enclosure 12 with a top 14, a bottom 15, a pair of sidewalls 16 and 18, a back wall 19, as well as a dispensing cover 20. In exemplary embodiments, the various parts of the enclosure 12 may be formed out of a variety of materials and in one or more separate pieces. The napkin dispenser 10 may be fabricated of metal, plastic or any other suitable material. In one embodiment the top 14, bottom 15, sidewalls 16 and 18 and back wall 19 may be formed as a single piece with the dispensing cover 20 formed as a separate piece that may be removable affixed to the enclosure 12 to form the napkin dispenser 10. The dispensing cover 20 includes a dispensing aperture 22 having a major axis 24, that is, the length or span of the dispensing aperture 22 and a minor axis 26, that is, the width of the dispensing aperture 22. In one embodiment, the major axis 24 of the dispensing aperture 22 may be generally smaller than the width of napkins to be dispensed. In other embodiments, the major axis 24 of the dispensing aperture 22 may be generally equal to or greater than width of the napkins to be dispensed. As can be seen from FIG. 1, a napkin 25 is drawn through the dispensing aperture 22.

In one embodiment, dispensing cover 20 may be removably affixed to the enclosure 12 to provide for loading a napkin stack 29. Napkin stack 29 may be a stack of single folded, interfolded or multi-folded napkins as are well known in the art. In the interior of the napkin dispenser 10 a pressure carriage 27 may be provided which may be slidably mounted about a pair of mounting rails 30 as can be most clearly seen in FIG. 2. The napkin dispenser 10 may further include a spring device 28, which can be in the form of a reel which is operative to urge pressure carriage 27 and thus napkin stack 29 towards the dispensing cover 20. In another embodiment, the napkin stack 29 may be in direct contact with the spring device 28 in order to urge the napkin stack 29 towards the dispensing cover 20. In exemplary embodiments, the spring device 28 may be a coil spring, a reel spring or any other suitable pressure device.

In exemplary embodiments, the pressure carriage 27 may be affixed to a pressure plate 31 which is used to distribute the pressure load about the napkin stack 29. The bottom 15 of the napkin dispenser 10 may be provided with coasters, such as coasters 21, 23 which may be rubber or any suitable material for placing on a counter top or table. In general the napkin dispenser 10 operates by way of loading a napkin stack 29 between pressure carriage 27 and dispensing cover 20. The napkin stack 29 may include interfolded, single folded or multi-folded napkins if so desired, and the napkin stack 29 is urged towards dispensing cover 20 by way of spring device 28. Although the napkin dispenser 10 is illustrated as a table-top style napkin dispenser 10, it will be understood by a person of ordinary skill in the art that the dispensing cover 20 can be used with various napkin dispenser configurations including, but not limited to, a pop-up style napkin dispenser, gravity feed vertical napkin dispenser, or the like.

Figure 3:
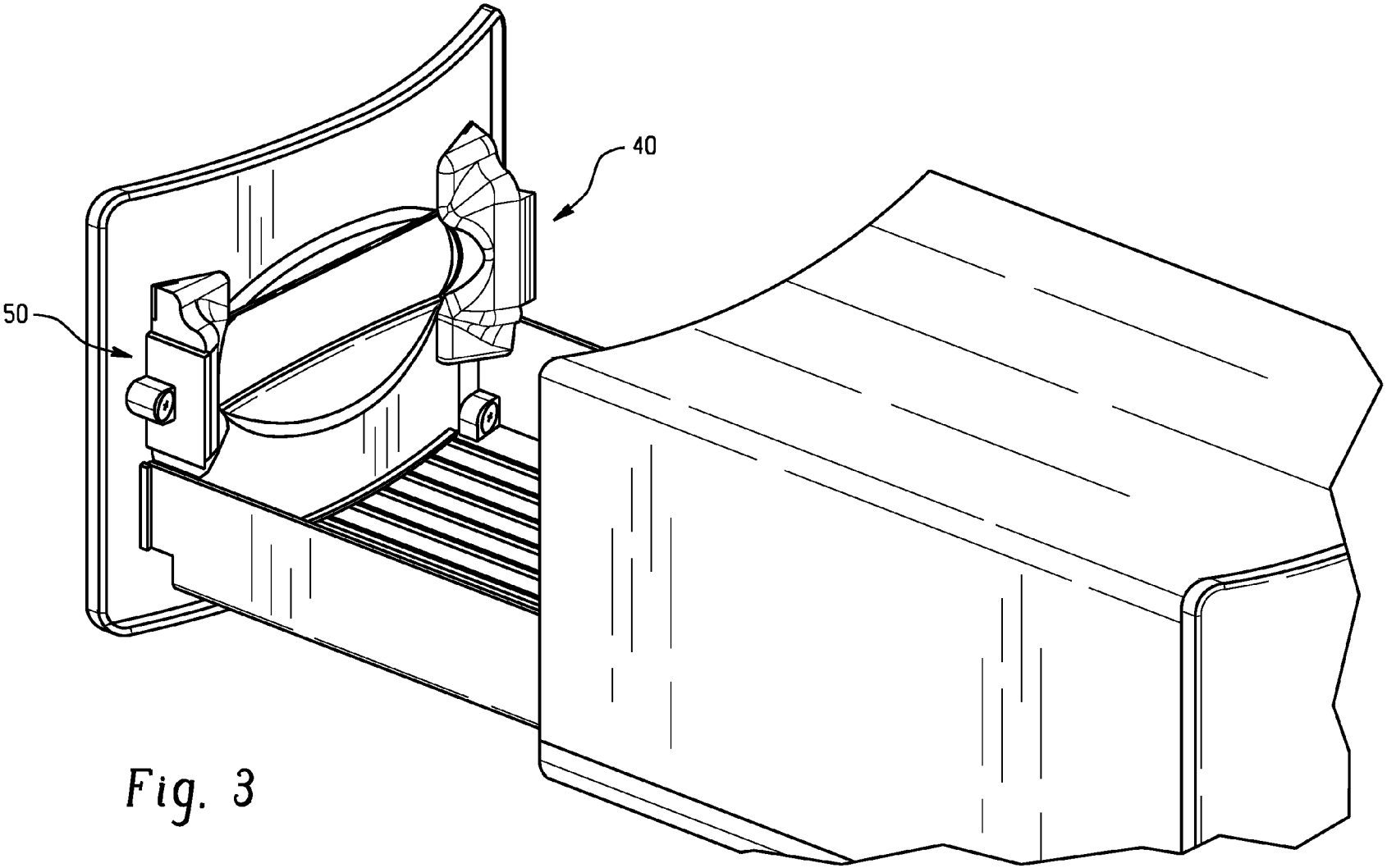
FIG. 3 is an partial perspective view of the napkin dispenser of FIG. 1.

As most clearly shown in FIG. 3, napkin dispenser 10 includes a dispensing cover 20 having an outer surface and an inner surface 39. In one embodiment, the dispensing cover 20 may have a generally concave shape. The dispensing cover 20 includes support members 40, 50 that are disposed on the inner surface 39 of the dispensing cover 20 on each side of the dispensing aperture 22. In one embodiment, the support members 40, 50 may be disposed on each side of the major axis 24 of the dispensing aperture 22. In one embodiment, the support members 40, 50, may have a width that ranges from approximately twenty-five percent of the width of the dispensing cover 20 to eighty-five percent of the width of the dispensing cover 20. The support members 40, 50 are designed to support a substantial portion of the force urging the napkin stack 29 towards the dispensing cover 20, such that the force exerted by the napkin stack 29 on the inner surface 39 of the dispensing cover 20 is minimized. By reducing, or eliminating, the force exerted by the napkin stack 29 on the inner surface 39 of the dispensing cover 20, the support members 40, 50 facilitate removing napkins 25 from the napkin dispenser 10 in a one by one fashion without damage to the napkin 25.

Figure 4:
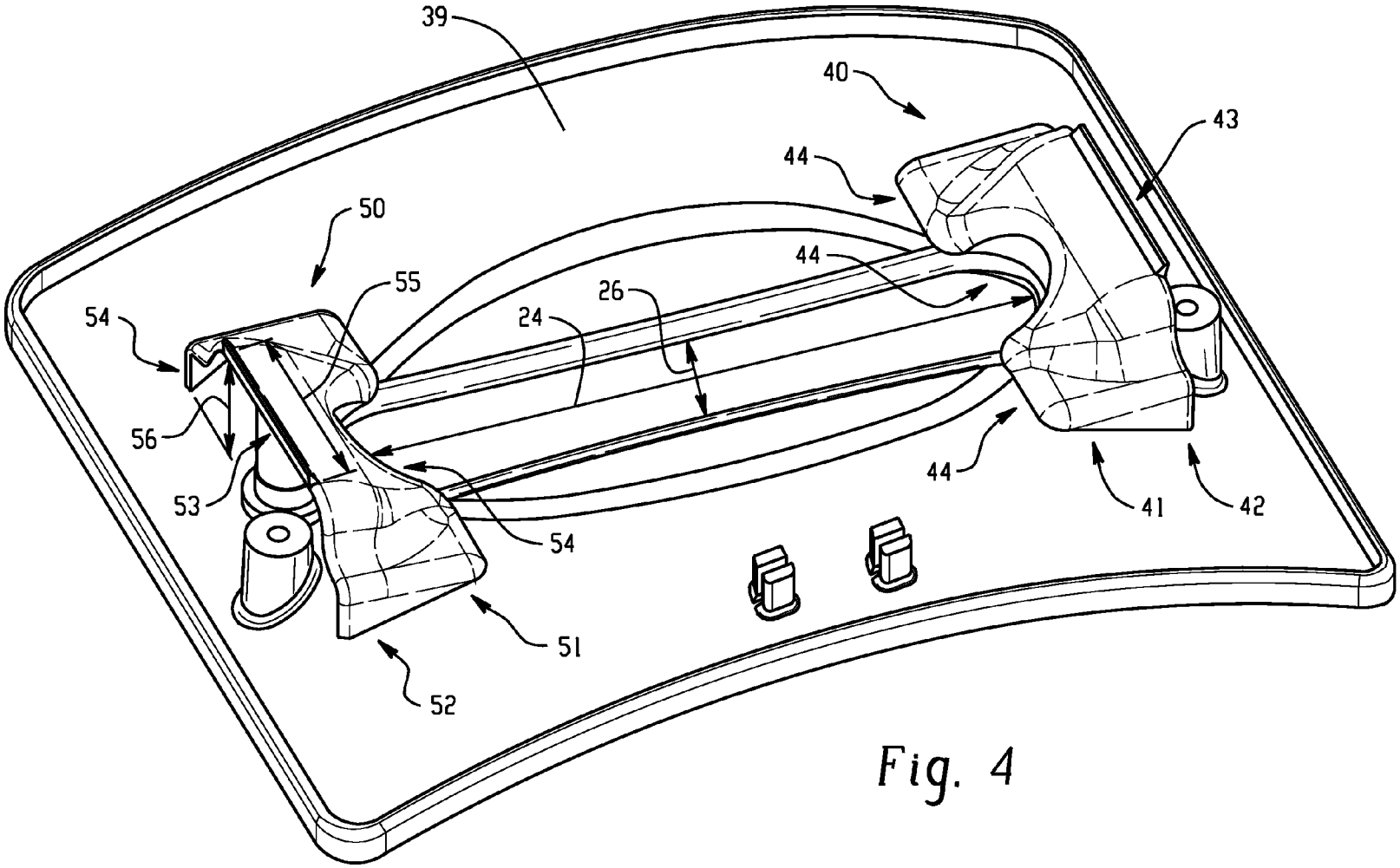
FIG. 4 is a rear perspective view showing the dispensing cover of the napkin dispenser of FIG. 1.

Referring now to FIG. 4, the inner surface 39 of the dispensing cover 20 of the napkin dispenser 10 is shown. In an exemplary embodiment, the support members 40, 50 may include first outer portions 41, 51 and second outer portions 42, 52, respectively. In addition, the support members 40 and 50 may include central portions 43, 53, respectively. In one embodiment, the width 55 of the central portion may be approximately equal to the length of the minor axis 26 of the dispensing aperture 22. The dispensing aperture 22 may include rounded ends 44, 54 on either end of the major axis 24 and at least a portion of the support members 40, 50 may extend past the rounded ends 44, 54 of the dispensing aperture 22. In exemplary embodiments, the first outer portions 41, 51 extend past the rounded ends 44, 54 of the dispensing aperture 22.

In one embodiment, the support members 40, 50 may be tapered in shape from the second outer portion 42, 52 towards the first outer portion 41, 51 and from the central portion 43, 53 towards the dispensing aperture 22. The distance 56 between at least a portion of the surface of the support members 40, 50 and the inner surface 39 generally increases as the distance between the surface of the support member 40, 50 and the dispensing aperture 22 increases. In addition, the distance 56 between the surface of the outer portions 41, 42, 51, 52 of the support members 40, 50 and the inner surface 39 generally decreases as the distance between the outer portions 41, 42, 51, 52 and the central portions 43, 53 increases.

Figure 5:
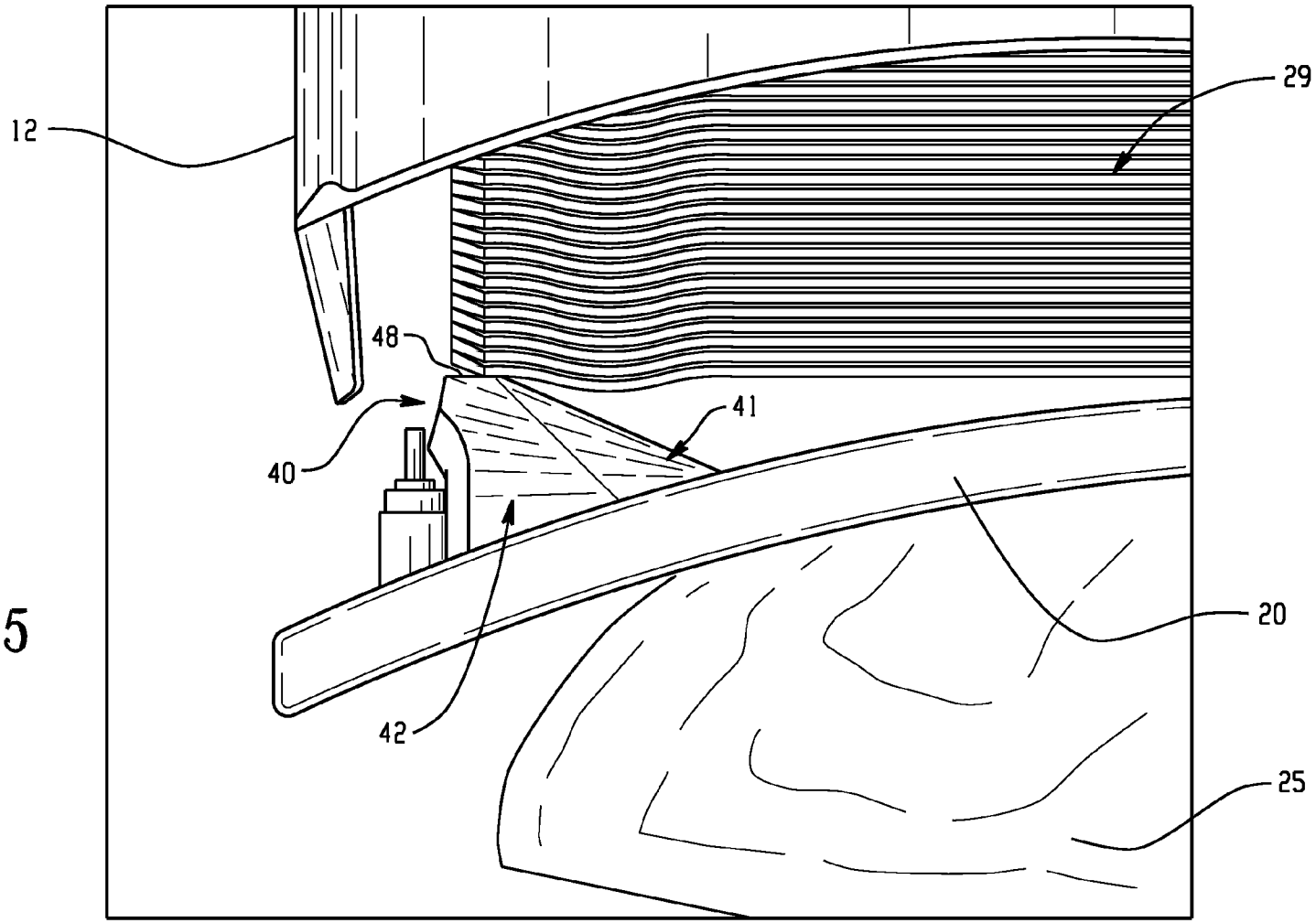
FIG. 5 is a cross sectional side view of a napkin dispenser constructed in accordance with an exemplary embodiment with a stack of napkins loaded therein.

In one embodiment, most clearly shown in FIG. 5, the central portion 43 of the support member 40 may include a plateau portion 48 in which the distance between the surface of the support members 40 and the inner surface 39 remains approximately constant as the distance between the surface of the support member 40 and the dispensing aperture 22 increases. The plateau portion 48 can be disposed adjacent to at least part of the second outer portion 42 of the support member 40. In one embodiment, the top napkin of the napkin stack 29 is in contact with the plateau portion 48 of the support member 40 until the napkin 25 being dispensed is pulled through the dispensing aperture 22. As the napkin 25 is pulled through the dispensing aperture 22, the top napkin of the napkin stack 29 slides towards the dispensing aperture 22 such that it is no longer in contact with the plateau portion 48. As the top napkin of the napkin stack 29 progresses towards the dispensing aperture 22, the force exerted by the napkin stack 29 on the napkin decreases.

In an exemplary embodiment, the distance from the central portion 43 of one support member 40 to the central portion 53 of the second support member 50 may be approximately the width of the napkin 25 to be dispensed. The support members 40, 50 may be disposed such that the central portions 43, 53 contact the napkin stack 29 and prevent the napkin stack 29 from exerting substantial force on the inner surface 39 of the dispensing cover 20. The top napkin of the napkin stack 29 contacts the central portions 43, 53 of support members 40, 50 which provides resistance to the force urging the napkin stack 29 towards the dispensing cover 20. As the napkin 25 to be dispensed is pulled through the dispensing aperture 22 it pulls on the next napkin from the top of the napkin stack 29. This force causes the top of the napkin stack 29 to slide across at least a portion the surface of the support members 40, 50, generally in a direction towards the dispensing aperture 22. When the top of the napkin stack 29 slides towards the dispensing aperture 22 the amount of the force between the dispensing cover 20 and napkin stack 29 exerted on the napkin 25 is decreased. Accordingly, the napkin 25 can be dispensed from the napkin dispenser 10 one at a time without damaging the napkin 25.

The support members 40, 50 should be shaped such that a napkin 25 being removed from the napkin stack 29 and pulled towards the dispensing aperture 22 will smoothly slide along the surface of the support members 40, 50. In addition, the surface of the support members 40, 50 should be free from any sharp edges or rough surfaces that would impede the napkin 25 from being dispensed or cause damage to the napkin 25. Accordingly, the napkin 25 being dispensed from the napkin stack 29 through the dispensing aperture 22 will not be torn or otherwise damaged while it is being dispensed.

Figure 6:
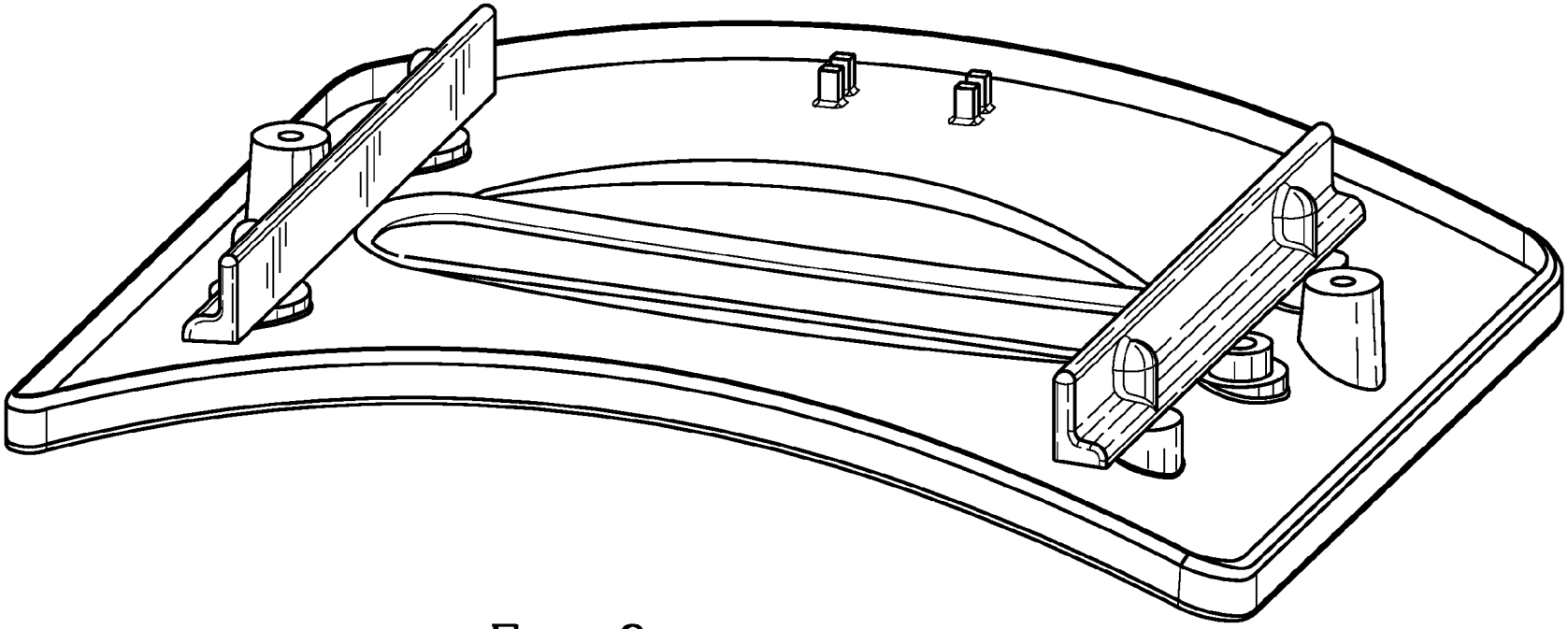
FIG. 6 is a rear perspective view showing a dispensing cover for a napkin dispenser.
Figure 7:
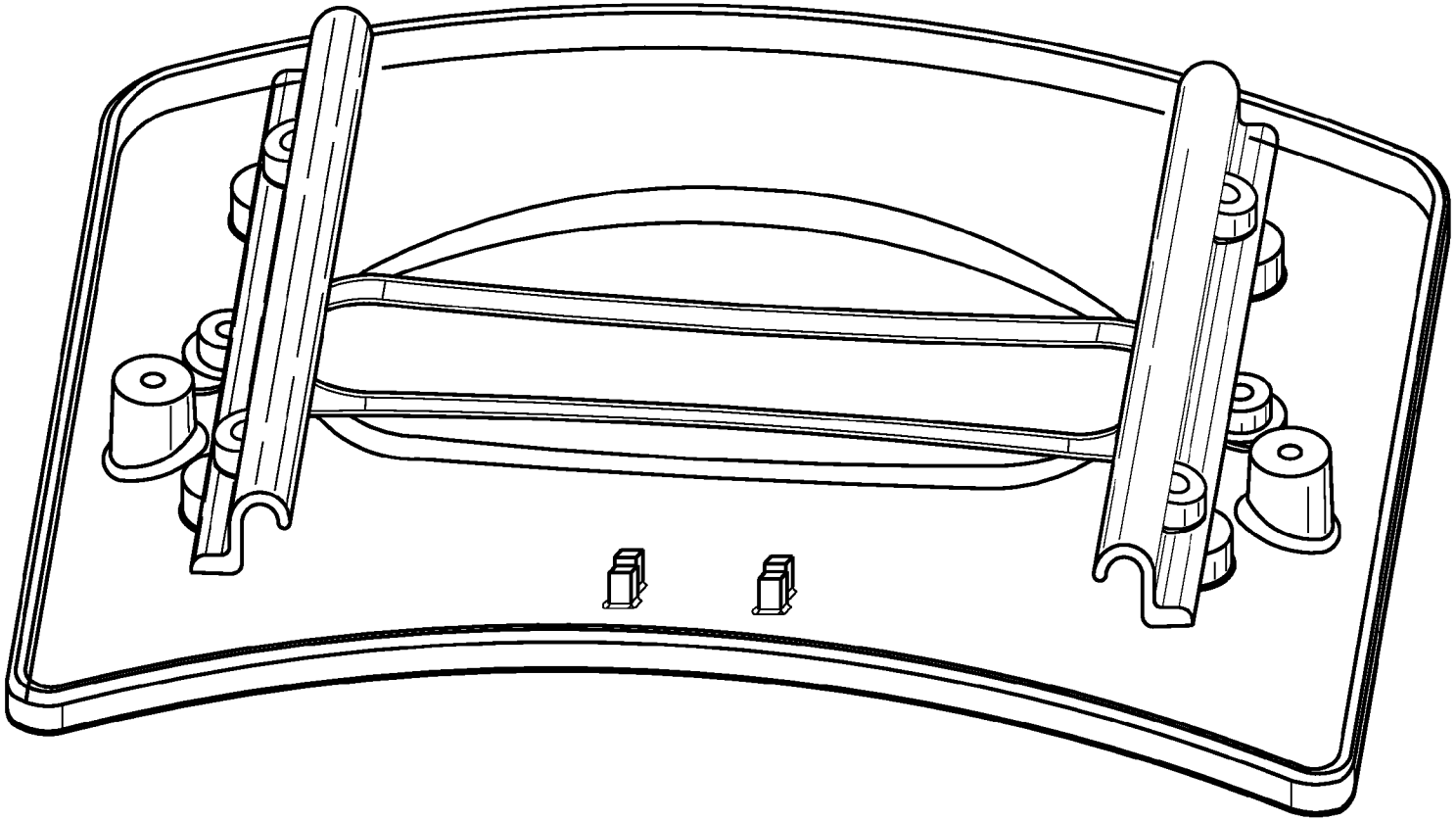
FIG. 7 is a rear perspective view showing another dispensing cover for a napkin dispenser.

The performance of napkin dispenser 10 including the dispensing cover 20 was tested and compared to various other types of available napkin dispensers in order to illustrate and quantify the performance improvements associated with the dispensing cover 20 (referred to as "Dispenser #1"). One of the other napkin dispenser covers that was tested is illustrated in FIG. 6 and was modeled after an embodiment described in U.S. Pat. No. 4,679,703 (referred to as "Dispenser #2"). Another napkin dispenser cover that was tested is illustrated in FIG. 7 and was also modeled after an embodiment described in U.S. Pat. No. 4,679,703 with a slight change to the size and location of the support rods (referred to as "Dispenser #3").

The following terms are used to illustrate the various types of failures that were experienced during testing of the napkin dispensers: tabs; tears; multiples; no tails; and <1" tails. As used herein, a tab is when less than ¼ of the napkin separates from the napkin being dispensed and the remaining portion of the napkin remains in the dispenser but can be dispensed without any major difficulties. As used herein, a tear is when the napkin is ripped, but has not separated into pieces and a catastrophic failure is when the napkin tears into two or more pieces and the portion of the napkin remaining in the dispenser is difficult to remove due to the napkin being caught inside the dispenser. As used herein, a multiple is when two or more napkins come out of the dispensing aperture while pulling a single napkin tail. As used herein, a "<1" tail" is when there is less than 1 inch of napkin sticking out beyond the dispenser opening and a no-tail is when there is no exposed tail available to grip, but the free end is able to be retrieved by reaching into the dispensing aperture. As used herein, a non-dispensable refers to when there is no-tail available to grip and the free end can not be reached through the dispensing aperture, this may occur due to napkins falling flat or due to the pressure plate not advancing the napkin stack properly.

Each of the napkin dispensers was subjected to testing to evaluate the performance of the napkin dispenser. Each test was begun by examining two sleeves of napkins for any defects and loading the napkins into the dispensers. Next, the napkins in the dispenser were marked, or color-coded, such that the initial position of the napkin in the napkin stack could be determined after the napkin was dispensed. The dispensers were then each tested by dispensing the napkins one at a time. During the tests, the napkins were hand pulled from the dispensers using a variety of forces and speeds to simulate use by typical consumers. During subsequent tests, the napkins were dispensed in the following directions: directly forward; at a forty-five degree upward angle; at a forty-five degree rightward angle; and at a forty-five degree leftward angle. During the testing the number of tabs, tears, multiples, no tails and <1" tails observed for each dispenser were tabulated. The no-tails at the beginning of the dispensing or between the napkin sleeves were not included in the tabulation.

The tables below illustrate the results of the performance testing on the various napkin dispenser covers. Table 1 illustrates the results of performance testing with a single ply napkin product while table 2 illustrates the results of performance testing with a two ply napkin product.

TABLE 1

| | Types of Dispensing Failures | | | | |
|---|---|---|---|---|---|
| | Tabs | Tears | Multiples | Partial or No Tails | Failure Percentage |
| Dispenser #1 | 0.06% | 0.84% | 0.04% | 0.00% | 0.94% |
| Dispenser #2 | 1.10% | 7.60% | 0.08% | 0.02% | 8.80% |
| Dispenser #3 | >20% | >60% | — | — | >80% |

TABLE 2

| | Types of Dispensing Failures. | | | | |
|---|---|---|---|---|---|
| | Tabs | Tears | Multiples | Partial or No Tails | Failure Percentage |
| Dispenser #1 | 0.06% | 1.05% | 0.02% | 0.00% | 1.13% |
| Dispenser #2 | 0.12% | 6.08% | 0.02% | 0.00% | 6.22% |
| Dispenser #3 | estimated >20% | estimated >60% | — | — | estimated >80% |

As illustrated by the performance testing results, the design of the dispensing cover 20 results in a substantial improvement in the failure rate for dispensing napkins from the napkin dispenser. The average failure rate for napkins dispensed with the dispensing cover 20 is approximately one percent while the next best design tested resulted in a failure rate of approximately six percent. Accordingly, the design of the dispensing cover 20 results in an approximately eighty percent reduction in the failure rate.

The terms "napkin", "napkin stack", "sheet products", "roll of product", or "stack of sheet product" as used herein is inclusive of natural and/or synthetic cloth or paper sheets and may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and melt-blown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general, sheet products are thin in comparison to their length and breadth and exhibit a relatively flat planar configuration and are flexible to permit folding, rolling, stacking, and the like. Individual sheets may be sized as desired to accommodate the many uses of the sheet products. Stacked sheet product may be provided in an interfolded arrangement that may include u-folded sheet product, z-folded sheet product, or accordion-folded sheet product having perforation lines suitably sized and arranged to accommodate one-at-a-time dispensing of the sheet product.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A cover for a sheet product dispenser, the cover comprising:

an elongated dispensing aperture defined in a wall of the cover and extending from an inner surface to an outer surface of the wall, wherein the elongated dispensing aperture comprises a major axis corresponding to a length of the elongated dispensing aperture and a minor axis corresponding to a width of the elongated dispensing aperture; and a pair of support members disposed on the inner surface of the wall at opposing ends of the major axis of the elongated dispensing aperture, wherein each of the support members comprises a central portion and a pair of outer portions disposed on opposing sides of the central portion;

wherein a height of at least a portion of the central portion relative to the inner surface generally increases as a distance from the elongated dispensing aperture increases in a direction of the major axis;

wherein a height of the outer portions relative to the inner surface generally decreases as a distance from the central portion increases in a direction of the minor axis; and wherein each of the support members has a width that is greater than the width of the elongated dispensing aperture and less than a width of the cover.

2. The cover of claim 1, wherein each of the support members further comprises a notch extending about the respective end of the elongated dispensing aperture and corresponding to a shape of the respective end.

3. The cover of claim 1, wherein the height of the outer portions relative to the inner surface generally increases as a distance from the elongated dispensing aperture increases in the direction of the major axis.

4. The cover of claim 1, wherein the central portion further comprises a plateau portion extending generally parallel to the minor axis of the elongated dispensing aperture and along which the height of the central portion relative to the inner surface is generally constant.

5. The cover of claim 1, wherein the ends of the elongated dispensing aperture each have a rounded shape.

6. The cover of claim 1, wherein at least a portion of the central portion extends over the respective end of the elongated dispensing aperture.

7. The cover of claim 1, wherein the central portion has a width approximately equal to the width of the elongated dispensing aperture.

8. The cover of claim 1, wherein each of the support members extends around the respective end of the elongated dispensing aperture and at least partially along opposing sides of the elongated dispensing aperture.

9. The cover of claim 3, wherein a maximum height of the outer portions is less than a maximum height of the central portion.

10. A sheet product dispenser for dispensing a sheet product stack, the sheet product dispenser comprising:

an enclosure;

a spring device disposed inside the enclosure and in communication with the sheet product stack;

a dispensing cover removably affixed to the enclosure, the dispensing cover comprising:

an elongated dispensing aperture defined in a wall of the dispensing cover and extending from an inner surface to an outer surface of the wall, wherein the elongated dispensing aperture comprises a major axis corresponding to a length of the elongated dispensing aperture and a minor axis corresponding to a width of the elongated dispensing aperture; and a pair of support members disposed on the inner surface of the wall at opposing ends of the major axis of the elongated dispensing aperture, wherein each of the support members is operable for opposing a force exerted by the sheet product stack, and wherein each of the support members comprises a central portion and a pair of outer portions disposed on opposing sides of the central portion;

wherein a height of at least a portion of the central portion relative to the inner surface generally increases as a distance from the elongated dispensing aperture increases in a direction of the major axis;

wherein a height of the outer portions relative to the inner surface generally decreases as a distance from the central portion increases in a direction of the minor axis; and wherein each of the support members has a width that is greater than the width of the elongated dispensing aperture and less than a width of the cover; and wherein the spring device exerts a force on the sheet product stack urging it towards the dispensing cover.

11. The sheet product dispenser of claim 10, wherein each of the support members further comprises a notch extending about the respective end of the elongated dispensing aperture and corresponding to a shape of the respective end.

12. The sheet product dispenser of claim 10, wherein the height of the outer portions relative to the inner surface generally increases as a distance from the elongated dispensing aperture increases in the direction of the major axis.

13. The sheet product dispenser of claim 10, wherein the central portion further comprises a plateau portion extending generally parallel to the minor axis of the elongated dispensing aperture and along which the height of the central portion relative to the inner surface is generally constant.

14. The sheet product dispenser of claim 10, wherein the ends of the elongated dispensing aperture each have a rounded shape.

15. The sheet product dispenser of claim 10, wherein at least a portion of the central portion extends over the respective end of the elongated dispensing aperture.

16. The sheet product dispenser of claim 10, wherein the wall of the dispensing cover has a generally concave shape such that the inner surface curves inwardly towards the enclosure.

17. The sheet product dispenser of claim 10, wherein at least a portion of the central portion is operable for contacting a leading sheet of the sheet product stack near a respective end of the leading sheet.

18. The sheet product dispenser of claim 10, wherein the width of each of the support members is less than a width of the sheet product stack.

19. A sheet product dispenser for dispensing a sheet product stack, the sheet product dispenser comprising:

an enclosure;

a pressure carriage slidably disposed inside the enclosure;

a dispensing cover removably affixed to the enclosure, the dispensing cover comprising:

an elongated dispensing aperture defined in a wall of the dispensing cover and extending from an inner surface to an outer surface of the wall, wherein the elongated dispensing aperture comprises a major axis corresponding to a length of the elongated dispensing aperture and a minor axis corresponding to a width of the elongated dispensing aperture; and a pair of support members disposed on the inner surface of the wall at opposing ends of the major axis of the elongated dispensing aperture, wherein each of the support members comprises a central portion and a pair of outer portions disposed on opposing sides of the central portion;

wherein a height of at least a portion of the central portion relative to the inner surface generally increases as a distance from the elongated dispensing aperture increases in a direction of the major axis;

wherein a height of the outer portions relative to the inner surface generally decreases as a distance from the central portion increases in a direction of the minor axis; and wherein each of the support members has a width that is greater than the width of the elongated dispensing aperture and less than a width of the cover.

20. The sheet product dispenser of claim 19, wherein each of the support members further comprises a notch extending about the respective end of the elongated dispensing aperture and corresponding to a shape of the respective end.

21. The sheet product dispenser of claim 19, wherein the height of the outer portions relative to the inner surface generally increases as a distance from the elongated dispensing aperture increases in the direction of the major axis.

22. The sheet product dispenser of claim 19, wherein the ends of the elongated dispensing aperture each have a rounded shape.

23. The sheet product dispenser of claim 19, wherein the wall of the dispensing cover has a generally concave shape such that the inner surface curves inwardly towards the enclosure.

24. The sheet product dispenser of claim 19, wherein at least a portion of the central portion extends over the respective end of the elongated dispensing aperture.

25. The sheet product dispenser of claim 19, wherein the central portion further comprises a plateau portion extending generally parallel to the minor axis of the elongated dispensing aperture and along which the height of the central portion relative to the inner surface is generally constant.

26. The sheet product dispenser of claim 19, wherein at least a portion of the central portion is operable for contacting a leading sheet of the sheet product stack near a respective end of the leading sheet.

* * * * *